US006747408B2

(12) United States Patent
Sung et al.

(10) Patent No.: US 6,747,408 B2
(45) Date of Patent: Jun. 8, 2004

(54) PLASMA DISPLAY DEVICE

(75) Inventors: Wen-Fa Sung, Hsihchu (TW); Yao-Ching Su, TaiNan Hsien (TW); Jin-Yuh Lu, Taipei (TW)

(73) Assignee: Au Optronics Corp., Hsinchu (TW)

( * ) Notice: Subject to any disclaimer, the term of this patent is extended or adjusted under 35 U.S.C. 154(b) by 145 days.

(21) Appl. No.: 09/995,386

(22) Filed: Nov. 26, 2001

(65) Prior Publication Data

US 2002/0063528 A1 May 30, 2002

(30) Foreign Application Priority Data

Nov. 24, 2000 (TW) ..... 89124994 A

(51) Int. Cl.[7] ..... H01J 17/49; H01J 17/16

(52) U.S. Cl. ..... 313/582; 313/587; 313/586; 313/634; 445/25

(58) Field of Search ..... 313/582, 586, 313/587, 634–635; 445/24, 25; 345/60

(56) References Cited

U.S. PATENT DOCUMENTS 3,939,556 A * 2/1976 Borel et al. ..... 29/886
5,742,122 A * 4/1998 Amemiya et al. ..... 313/582
5,754,003 A 5/1998 Murai et al. ..... 313/582
6,353,287 B1 * 3/2002 Sasaki et al. ..... 313/582

* cited by examiner

*Primary Examiner*—Sandra O'Shea
*Assistant Examiner*—Anthony Perry
(74) *Attorney, Agent, or Firm*—Ladas & Parry

(57) ABSTRACT

A plasma display device is disclosed. The plasma display device has a first panel and a second panel parallel to each other. A dielectric layer is formed on the second panel, a plurality of barrier ribs are formed on the dielectric layer, and a plurality of buffer layers are formed opposite to the barrier ribs. The buffer layers have a first softening temperature, the barrier ribs have a second softening temperature, and the first softening temperature is lower than the second softening temperature. The buffer layers can be deformed and compressed at a temperature higher than the first softening temperature during a process for sealing the first and second panels, so as to unify heights of the barrier ribs.

16 Claims, 8 Drawing Sheets

PLASMA DISPLAY DEVICE

BACKGROUND OF THE INVENTION

1. Field of the Invention

The invention relates to a plasma display device, and more particularly to a plasma display device having uniform barrier ribs.

2. Description of the Related Art

Recently, flat panel displays, such as liquid crystal displays and plasma displays, become to replace traditional cathode ray tube displays. The plasma display is a flat panel displaying images by discharging gas, with lighter weight and thinner volume, a large viewable area, and no viewing-angle restriction.

The plasma display includes a front panel and a back panel, and a plurality of barrier ribs are formed on the back panel. These barrier ribs in the plasma display can be formed by a screen-printing method and/or a sandblasting method. These barrier ribs with different heights cause a serious problem. For example, a height difference between the highest and lowest barrier ribs is about 10 $\mu$m, so that the highest barrier rib is easily cracked or broken because of the pressure formed during the assembly process of the front panel to the back panel.

A discharge display device is disclosed in U.S. Pat. No. 5,754,003. Referring to FIG. 6, a plurality of height adjusting layers 32 are formed on the front panel 101. These height adjusting layers 32 are corresponded with these barrier ribs 103. Each height adjusting layer 32 is made of a material having a low softening temperature. However, it is not easy to control the amount of the height adjusting layers 32, and some of the height adjusting layers 32 may overflow onto the phosphor layer 104 on the rear panel 102 at high temperatures, causing defects of the display.

SUMMARY OF THE INVENTION

To solve the above problems, it is an object of the present invention to provide a plasma display device to solve the problem of the height difference among the barrier ribs.

According to the object mentioned above, the present invention provides a plasma display device having a first panel and a second panel parallel to each other. A first dielectric layer is formed on the second panel, a plurality of barrier ribs are formed on the first dielectric layer, and a plurality of buffer layers are formed opposite to the barrier ribs. The buffer layers have a first softening temperature, the barrier ribs have a second softening temperature, and the first softening temperature is lower than the second softening temperature. The buffer layers can be deformed and compressed at a temperature higher than the first softening temperature during a process for sealing the first and second panels, so as to unify heights of the barrier ribs.

Each buffer layer can be disposed in the middle of each barrier rib or between the first dielectric layer and each barrier rib. Moreover, the width of each buffer layer is preferably not larger than the width of each barrier rib. Thus, the buffer layer has enough space to expand during a sealing process of the first panel and the second panel. The buffer layer will not easily overflow onto the phosphor layer of the plasma display device to produce defects.

Furthermore, the difference between the first softening temperature of the buffer layer and the second softening temperature of the barrier rib is about 20° C. to 100° C., and preferably about 20° C. to 30° C.

The material of the buffer layer is a mixture of oxide, such as a mixture of $Bi_2O_3$, $Li_2O$, $Na_2O$, CaO, . . . etc.

According to the present invention, the buffer layers can be formed on the first panel. A second dielectric layer is further formed on the first panel to cover the buffer layers. The dielectric layer includes a plurality of concave portions, and positions of the concave portions are corresponded with positions of the buffer layers. A protecting layer can be formed on the second dielectric layer.

According to the present invention, the buffer layers can be formed above the second dielectric layer, and the protecting layer can be formed to cover the buffer layers.

BRIEF DESCRIPTION OF THE DRAWINGS

This and other objects and features of the invention will become clear from the following description, taken in conjunction with the preferred embodiments with reference to the drawings, in which.

DETAILED DESCRIPTION OF THE PREFERRED EMBODIMENTS

First Embodiment

Figure 1A:
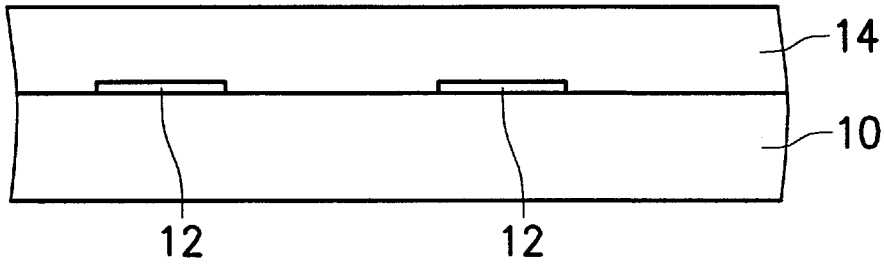
FIGS. 1A to 1D' are cross-sectional views illustrating the manufacturing process of the plasma display device according to the first embodiment of the invention.
Figure 1B:
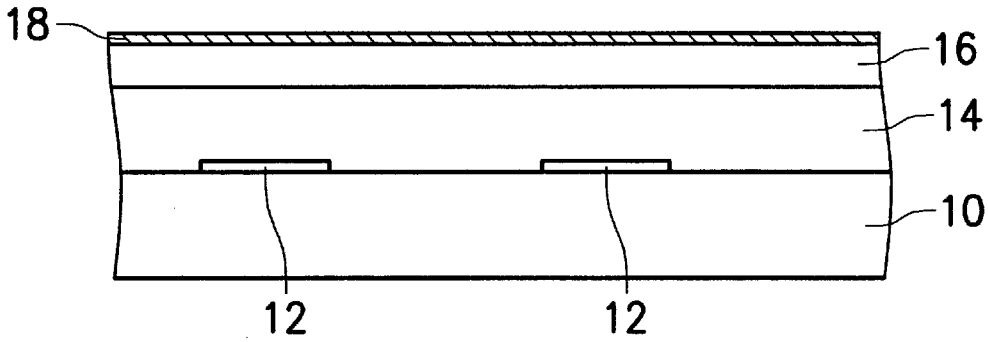
Figure 1C:
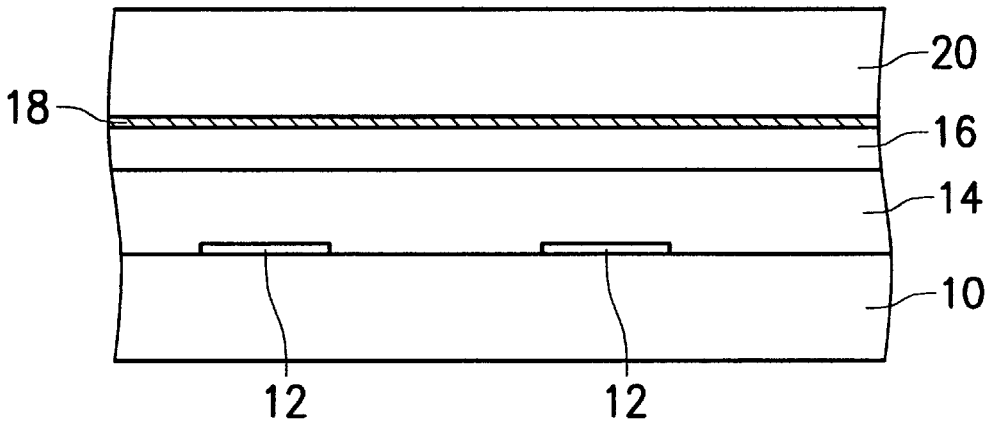

FIGS. 1A to 1D' are cross-sectional views illustrating the manufacturing steps of a rear panel of a plasma display device according to the first embodiment of the invention.

The plasma display device includes a first panel and a second panel, the second panel is the rear panel, and the first panel is the front panel which is not shown in these figures. First, referring to FIG. 1A, a plurality of data electrodes 12 is deposited on the rear glass substrate 10 of the rear panel, and then a dielectric layer 14 is formed on the rear glass substrate 10.

Next, a first rib-layer 16 is formed on dielectric layer 14 by traditional printing method. A buffer layer 18 having a thickness about 10 $\mu$m is formed on the first layer 16. A second rib-layer 20 is further formed on the buffer layer 18, and the total thickness of first and second rib-layers 16, 20 is about 120 $\mu$m. In the invention, the softening temperature of the buffer layer 18 is about 450° C. to 500° C. which is lower than the softening temperature of the first and second rib-layers 16, 20. Thus, the difference in these two softening temperatures is in a range of 20° C. to 100° C., preferably in a range of 20° C. to 30° C.

Next, a mask (not shown) is used to pattern the rib-layers 16, 20 and the buffer layer 18 to form a plurality of barrier ribs R1. Each barrier rib R1 is composed of a first sub-rib 16*a*, a buffer layer 18*a*, and a second sub-rib 20*a*. Thus, the buffer layer 18*a* is sandwiched between the second sub-rib 20*a* and the first sub-rib 16*a*. During a process for sealing the rear panel and front panel, the sealing temperature is higher than the softening temperature of the buffer layers 18 but lower than the softening temperature of these rib layers 16, 20. Therefore, the buffer layers can be deformed and compressed during the sealing process so as to unify heights of the barrier ribs R1.

Figure 1D:
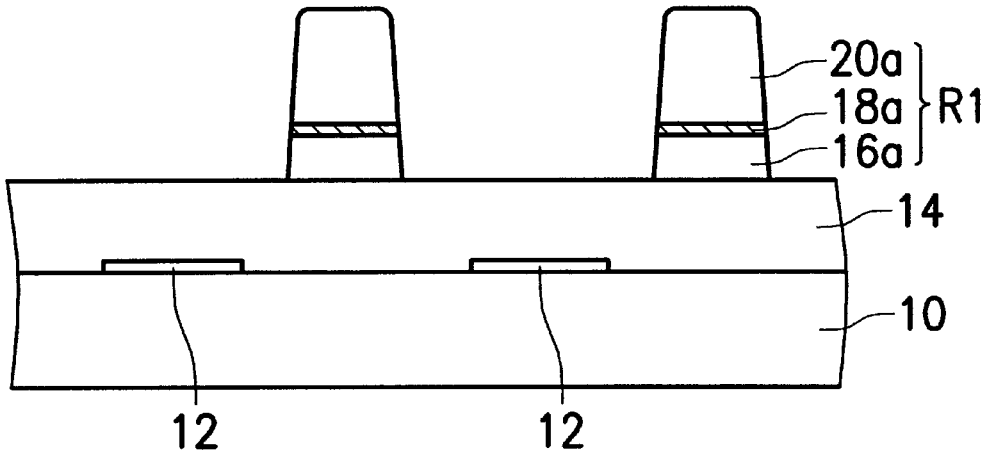
Figure 1D:
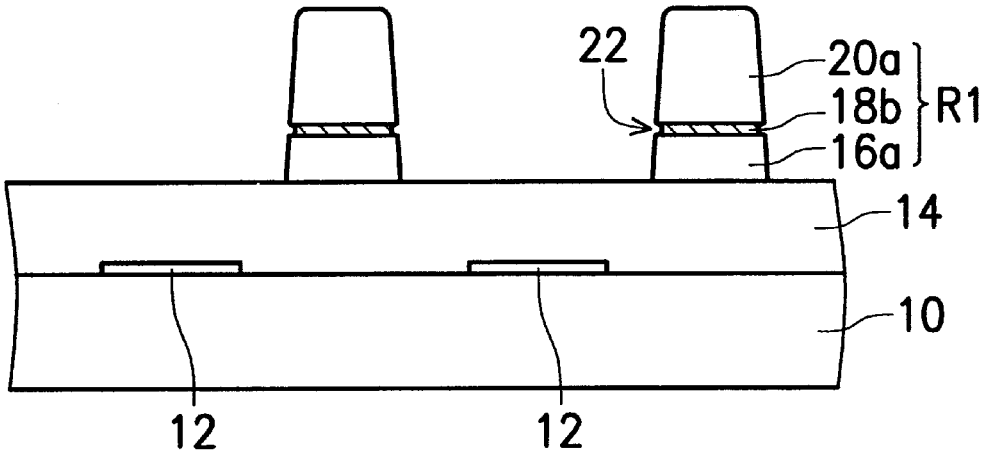

The barrier ribs R1 can be formed by a sandblasting process. During the sandblasting process, if the sandblasting rate of the buffer layer 18 is greater than the sandblasting rate of the first and second rib-layers 16, 20, the width of the patterned buffer layer is smaller that the widths of the patterned first or second rib-layers. A barrier rib R2 having a hollow portion 22 is formed as shown in FIG. 1D'. The hollow portion 22 provides an expanding space for the buffer layer 18*b* and prevents the buffer layer 18*b* from overflowing during the sealing process.

Second Embodiment

FIGS. 2A to 2D' are cross-sectional views illustrating the second embodiment of the invention.

Figure 2A:
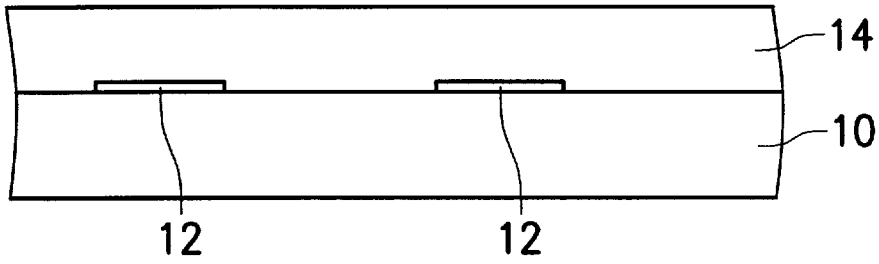
FIGS. 2A to 2D' are cross-sectional views illustrating the manufacturing process of the plasma display device according to the second embodiment of the invention.
Figure 2B:
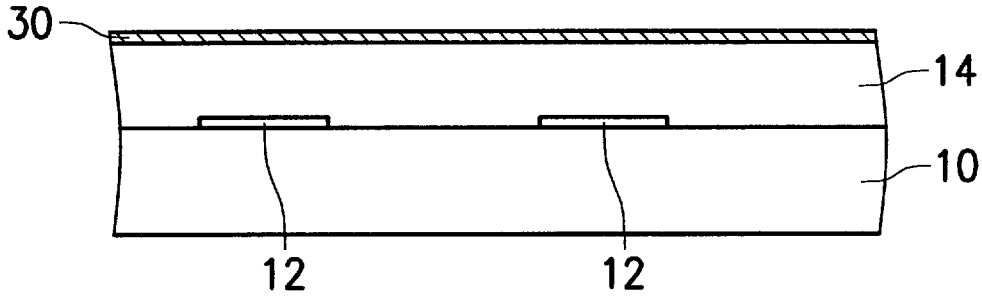
Figure 2C:
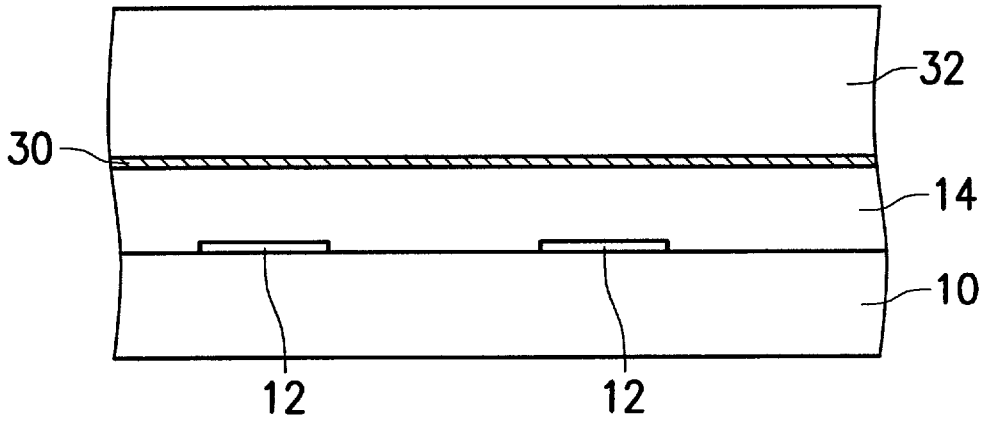

First, referring to FIG. 2A, a plurality of data electrodes 12 is deposited on the rear glass substrate 10 of the rear panel, and then a dielectric layer 14 is formed to cover these data electrodes.

Next, a buffer layer 30 having a thickness about 10 $\mu$m is formed on the dielectric layer 14 by traditional printing method, and then a rib layer 32, having a thickness about 120 $\mu$m, is formed on the buffer layer 30.

Next, the rib layer 32 and the buffer layer 30 is patterned to form a barrier rib R3 composed of a barrier sub-rib 32*a* and a buffer layer 30*a*. Thus, the buffer layer 30*a* is sandwiched between the barrier sub-rib 32*a* and the dielectric layer 14. In the second embodiment of the invention, during the sealing process between the rear panel and front panel, the sealing temperature is higher than the softening temperature of the buffer layers 30 but lower than the softening temperature of the rib layer 32. Therefore, the buffer layers can be deformed and compressed during the sealing process so as to unify heights of the barrier ribs R3.

Figure 2D:
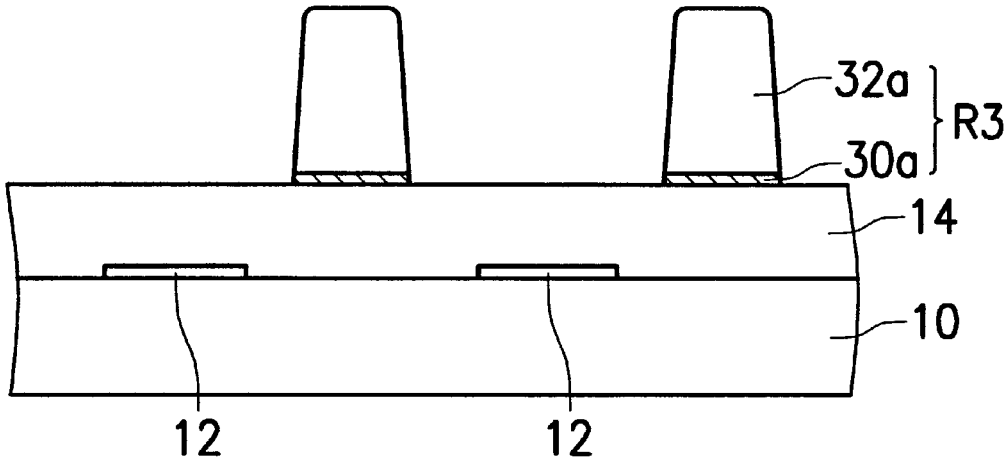
Figure 2D:
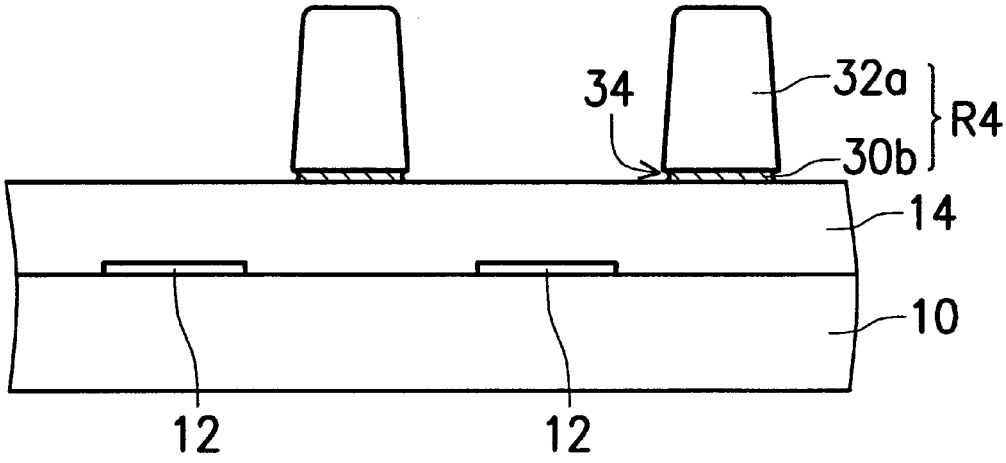

The barrier ribs R3 can be formed by a sandblasting process. During sandblasting, if the sandblasting rate of the buffer layer 30 is greater than the sandblasting rate of the rib layer 32, the width of the patterned buffer layer 30*b* is smaller that the widths of the patterned barrier sub-rib 32*a*. A barrier rib R4 having a hollow portion 34 is formed, as shown in FIG. 2D'. The hollow portion 34 provides an expanding space for the buffer layer 30*b* and prevents the buffer layer 30*b* from overflowing during the sealing process and solves the problem of point defects.

Third Embodiment

Figure 3A:
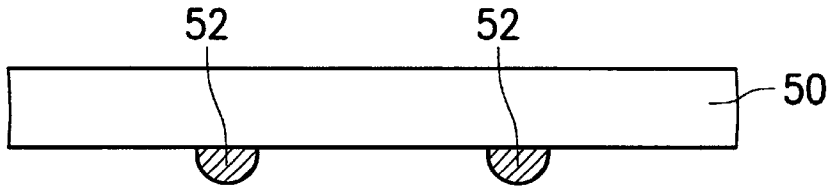
FIGS. 3A to 3C are cross-sectional views illustrating the manufacturing process of the plasma display according to the third embodiment of the invention.
Figure 3B:
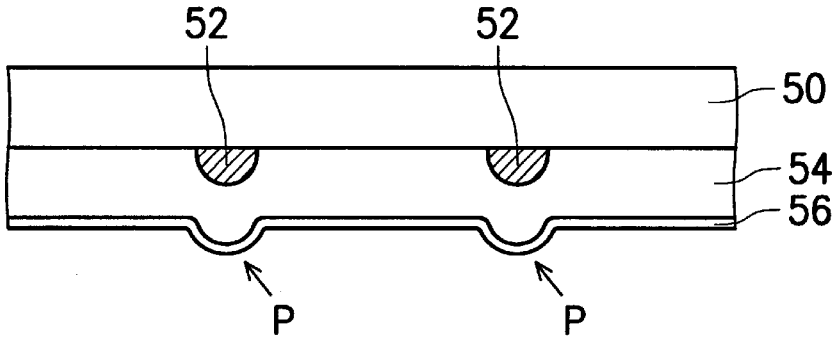
Figure 3C:
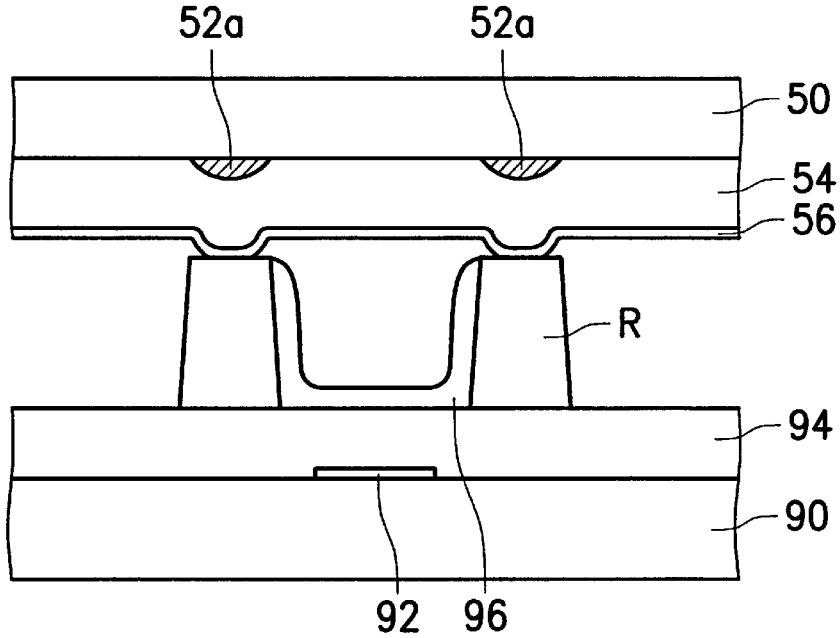

FIGS. 3A to 3C are cross-sectional views illustrating the manufacturing process of the plasma display device according to the third embodiment of the invention.

The plasma display device includes a front panel and a back panel. Referring to FIG. 3A, a plurality of buffer layers 52 is formed on a front glass substrate 50 of the front panel.

Next, referring to FIG. 3B, a dielectric layer 54 is formed on the front glass substrate 50 to cover the buffer layers 52. A protecting layer 56 is further formed on the dielectric layer 54. Because of the buffer layers 52, a plurality of protrusions P is formed above the protecting layer 56, as shown in FIG. 3B.

FIG. 3C is a schematic diagram showing the front and rear panels of the plasma display device. Referring to FIG. 3C, a plurality of data electrodes 92 are positioned on a rear glass substrate 90 of the rear panel. A dielectric layer 94 is formed on the rear glass substrate 90 to cover the data electrodes 92. A plurality of barrier ribs R is positioned on the dielectric layer 94, and a phosphor layer 96 is formed on the dielectric layer 94 and between two barrier ribs R. The positions of these buffer layers 52 and the protrusions P are corresponded with the positions of the barrier ribs R. The softening temperature of the buffer layers 52 is lower than the softening temperature of the barrier rib R. The difference between these two softening temperatures is preferably about 20° C. to 30° C. During the sealing process between the rear panel and front panel, the sealing temperature is higher than the softening temperature of the buffer layers 52 but lower than the softening temperature of the barrier rib R. Therefore, the buffer layers 52 can be deformed and compressed during the sealing process and the height of the protrusions P are also changed. The buffer layers 52 become a condensed structure 52*a* an each protrusion P can be in contact with each barrier rib R so as to prevent point defects.

Fourth Embodiment

Figure 4A:
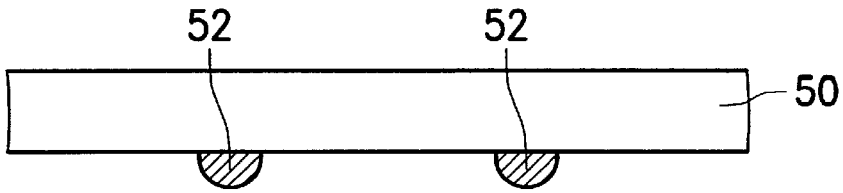
FIGS. 4A to 4C are cross-sectional views illustrating the manufacturing process of the plasma display according to the fourth embodiment of the invention.
Figure 4B:
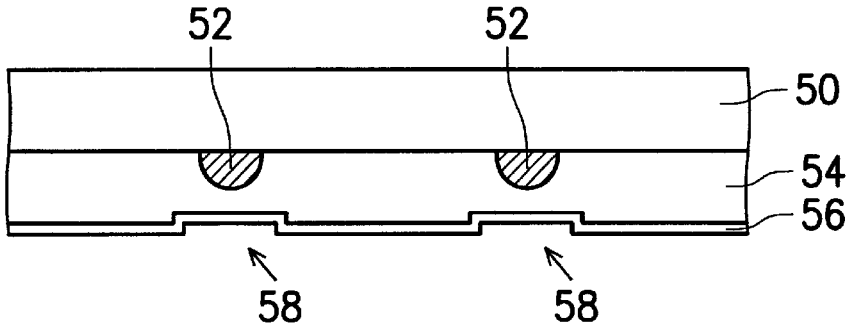
Figure 4C:
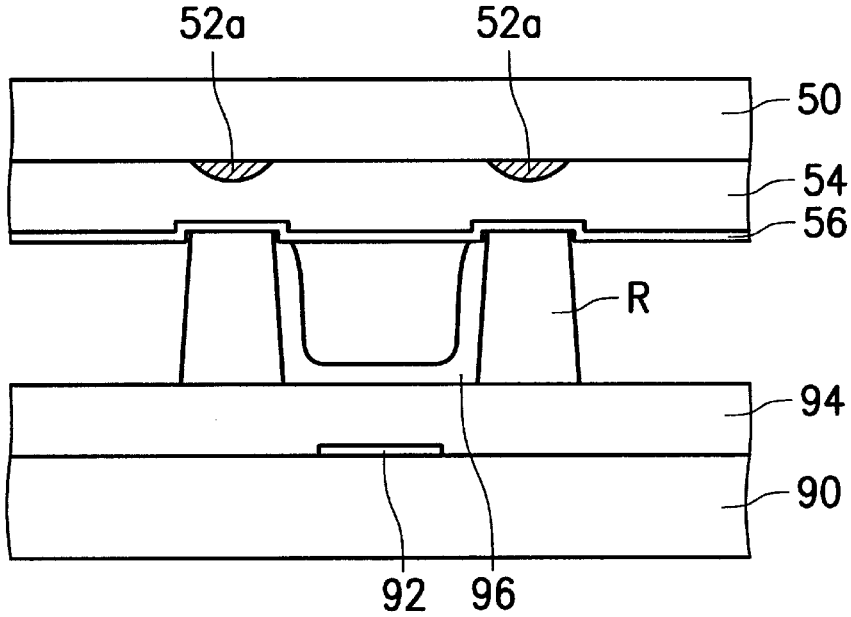

FIG. 4A to FIG. 4C are cross-sectional views illustrating the fourth embodiment of the invention.

The process of manufacturing the front panel of the plasma display in the fourth embodiment is almost the same as the process illustrated in the third embodiment. Nevertheless, referring to FIG. 4B, the dielectric layer 54 has a plurality of concave portions 58 in opposite to the positions of the buffer layers 52. A protecting layer 56 is formed on the dielectric layer 54, and then the protecting layer 56 also has a plurality of concave portions. Each concave portion has a shape matching the shape of each barrier rib R. Thus, the barrier ribs R can insert into the the concave portions 58, the structure of the plasma display device becomes more compact, and the quality of the plasma display device is then improved.

Fifth Embodiment

Figure 5A:
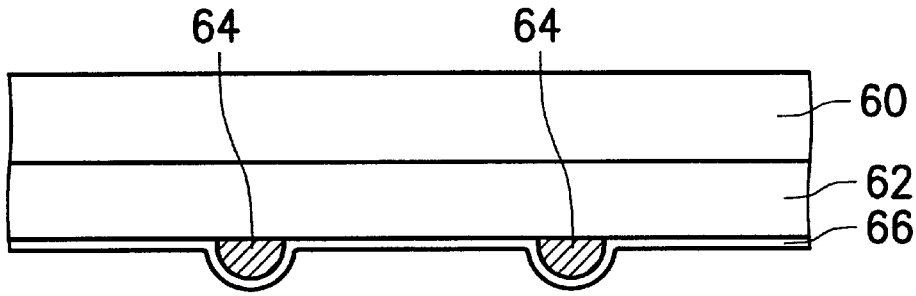
FIGS. 5A to 5B are cross-sectional views illustrating the manufacturing process of the plasma display device according to the fifth embodiment of the invention.
Figure 5B:
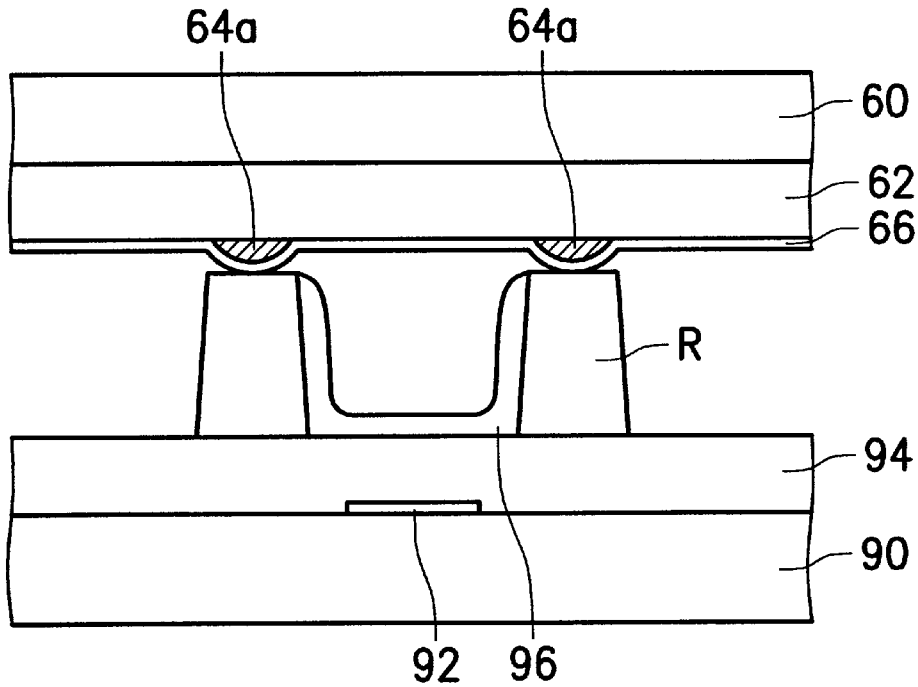
Figure 6:
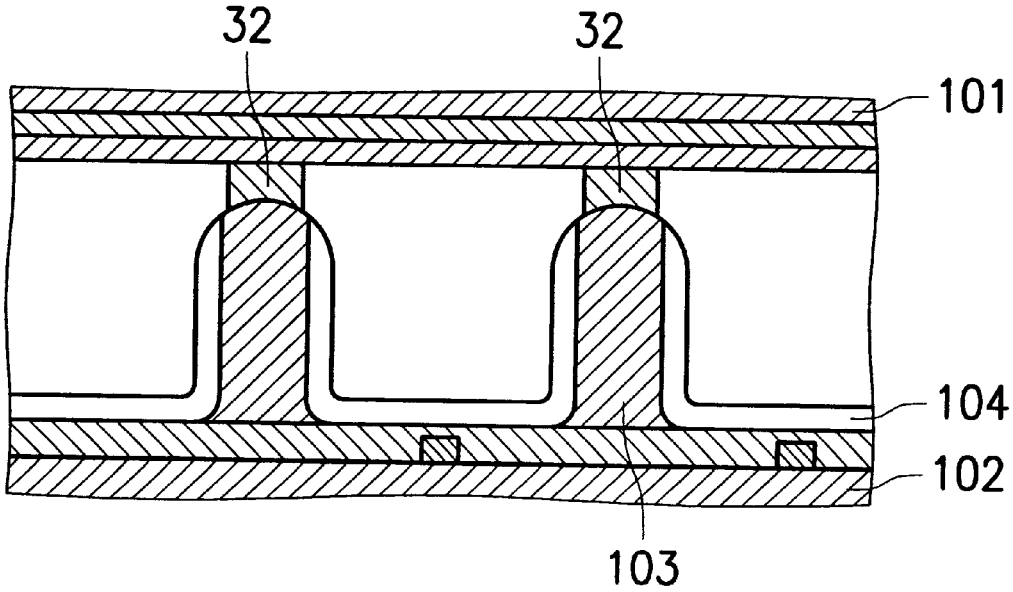
FIG. 6 (PRIOR ART)
FIG. 6 is a cross-sectional diagram showing a conventional plasma display device.

FIG. 5A and FIG. 5B are cross-sectional views illustrating the manufacturing process of the plasma display according to the fifth embodiment of the invention.

First, referring to FIG. 5A, a dielectric layer 62 is formed on a front glass substrate 60 a front panel. A plurality of buffer layers 64 are formed on the dielectric layer 62. Next, a protecting layer 66 is formed to cover the buffer layers 64. Referring to FIG. 5B, a rear panel mentioned in the third and fourth embodiments is provided. The position of the buffer layers 64 are corresponded with the positions of the barrier ribs R. Similarly, the softening temperature of the buffer layers 64 is lower than the softening temperature of the barrier ribs R. The difference of these softening temperature is preferably about 20° C. to 30° C. During the sealing process of the front and rear panels, the buffer layer 64 will be deformed to a condensed structure 64*a*. The deformation of the buffer layers 64*a* thus adjusts the height of the barrier ribs improves the compactness between the front panel and the rear panel.

According to the first and second embodiments, the rear panel of the plasma display includes: a rear glass substrate 10; a dielectric layer 14 formed on the rear glass substrate 10; a plurality of barrier ribs R1, R2, R3 or R4 formed on the dielectric layer 14; and a plurality of buffer layers 18*a*, 18*b*, 30*a* or 30*b*.

According to the third, fourth, and fifth embodiments, the front panel of the plasma display includes a front glass substrate 50, a plurality of buffer layers 52 formed on the front glass substrate 50. A plurality of barrier ribs R are positioned on the rear panel. The positions of the buffer layers are corresponded with the positions of the barrier ribs R.

The softening temperature of the buffer layers is lower than the softening temperature of the barrier ribs. The buffer layers are deformed and compressed during the sealing process so as to unify the height of the barrier ribs.

While the preferred embodiment of the present invention has been described, it is to be understood that modifications will be apparent to those skilled in the art without departing from the spirit of the invention. The scope of the invention, therefore, is to be determined solely by the following claims.

What is claimed is:

1. A plasma display device, comprising:

a first panel and a second panel parallel to each other;

a first dielectric layer formed on the second panel;

a plurality of barrier ribs formed on the first dielectric layer;

a plurality of buffer layers formed on the first panel; and a second dielectric layer further formed to cover the buffer layers, wherein the second dielectric layer includes a plurality of concave portions, and positions of the concave portions are corresponded with positions of the buffer layers;

wherein the buffer layers have a first softening temperature, the barrier ribs have a second softening temperature, and the first softening temperature is lower than the second softening temperature;

wherein the buffer layers are deformed and compressed at a temperature higher than the first softening temperature during a process for sealing the first and second panels, so as to unify heights of the barrier ribs.

2. The plasma display device as claimed in claim 1, wherein each barrier rib further comprises a first sub-rib and a second sub-rib, and the buffer layer is sandwiched between the first and second sub-ribs.

3. The plasma display device as claimed in claim 1, wherein the buffer layer is sandwiched between the barrier rib and the first dielectric layer.

4. The plasma display device as claimed in claim 1, wherein the thickness of the buffer layer is about 10 mm.

5. The plasma display device as claimed in claim 1, wherein each buffer layer has a first width, each barrier rib has a second width, and the first width is not larger than the second width.

6. The plasma display device as claimed in claim 1, wherein a difference between the first softening temperature of each buffer layer and the second softening temperature of each barrier rib is about 20° C. to 100° C.

7. The plasma display device as claimed in claim 6, wherein the difference between the first softening temperature and the second softening temperature is in a range of 20° C. to 30° C.

8. The plasma display device as claimed in claim 1, further comprising a protecting layer formed on the dielectric layer.

9. A plasma display device, comprising:

a first panel and a second panel parallel to each other;

a plurality of barrier ribs formed on the second panel;

a plurality of embedded buffer layers formed on the first panel opposite to the barrier ribs; and a blanket dielectric layer formed on the first panel and covering the buffer layers, wherein the buffer layers have a first softening temperature, the barrier ribs have a second softening temperature, and the first softening temperature is lower than the second softening temperature;

wherein the buffer layers are deformed and compressed at a temperature higher than the first softening temperature during a process for sealing the first and second panels, so as to unify heights of the barrier ribs.

10. The plasma display device as claimed in claim 9, wherein a dielectric layer is further formed to cover the buffer layers, the dielectric layer includes a plurality of concave portions, and positions of the concave portions are corresponded with positions of the buffer layers.

11. The plasma display device as claimed in claim 10, further comprising a protecting layer formed on the dielectric layer.

12. The plasma display device as claimed in claim 9, wherein a difference between the first softening temperature of each buffer layer and the second softening temperature of each barrier rib is about 20° C. to 100° C.

13. The plasma display device as claimed in claim 12, wherein the difference between the first softening temperature and the second softening temperature is in a range of 20° C. to 30° C.

14. A plasma display device, comprising:

a first panel and a second panel parallel to each other;

a plurality of barrier ribs formed on the second panel;

a dielectric layer formed on the first panel;

a protecting layer formed on the dielectric layer to cover the buffer layers; and a plurality of buffer layers formed on the dielectric layer and opposite to the barrier ribs, wherein the buffer layers have a first softening temperature, the barrier ribs have a second softening temperature, and the first softening temperature is lower than the second softening temperature;

wherein the buffer layers are deformed and compressed at a temperature higher than the first softening temperature during a process for sealing the first and second panels, so as to unify heights of the barrier ribs.

15. The plasma display device as claimed in claim 14, wherein a difference between the first softening temperature of each buffer layer and the second softening temperature of each barrier rib is about 20° C. to 100° C.

16. The plasma display device as claimed in claim 15, wherein the difference between the first softening temperature and the second softening temperature is in a range of 20° C. to 30° C.

* * * * *